US008434623B2

(12) United States Patent
Domke et al.

(10) Patent No.: US 8,434,623 B2
(45) Date of Patent: May 7, 2013

(54) INORGANIC PARTICLES COMPRISING AN ORGANIC COATING THAT CAN BE HYDROPHILICALLY/HYDROPHOBICALLY TEMPERATURE CONTROLLED

(75) Inventors: Imme Domke, Mannheim (DE); Alexej Michailovski, Mannheim (DE); Norbert Mronga, Dossenheim (DE); Hartmut Hibst, Schriesheim (DE); Juergen Tropsch, Roemerberg (DE); Susanne Stutz, Weinheim (DE)

(73) Assignees: BASF SE, Ludwigshafen (DE); Siemens AG, Munich (DE)

( * ) Notice: Subject to any disclaimer, the term of this patent is extended or adjusted under 35 U.S.C. 154(b) by 303 days.

(21) Appl. No.: 13/054,702

(22) PCT Filed: Jul. 17, 2009

(86) PCT No.: PCT/EP2009/059215

§ 371 (c)(1),
(2), (4) Date: Jan. 18, 2011

(87) PCT Pub. No.: WO2010/007157

PCT Pub. Date: Jan. 21, 2010

(65) Prior Publication Data

US 2011/0120919 A1 May 26, 2011

(30) Foreign Application Priority Data

Jul. 18, 2008 (EP) ..... 08160685

(51) Int. Cl.
*B03D 3/00* (2006.01)

(52) U.S. Cl.
USPC ..... 209/7; 209/3; 209/8; 209/9; 209/39; 209/46

(58) Field of Classification Search ..... 209/3, 7, 209/9, 39, 46, 47, 49
See application file for complete search history.

(56) References Cited

U.S. PATENT DOCUMENTS

| | | | | |
|---|---|---|---|---|
| 3,425,549 | A * | 2/1969 | Dickson et al. | 209/166 |
| 4,078,993 | A * | 3/1978 | Griffith et al. | 209/167 |
| 4,657,666 | A * | 4/1987 | Snook et al. | 209/8 |
| 4,834,898 | A | 5/1989 | Hwang | |
| 2003/0124744 | A1 * | 7/2003 | Furlong et al. | 436/526 |
| 2003/0175826 | A1 | 9/2003 | Furukawa et al. | |
| 2004/0206206 | A1 * | 10/2004 | Furlong et al. | 75/712 |
| 2010/0116747 | A1 * | 5/2010 | Franzreb et al. | 210/663 |
| 2011/0120954 | A1 | 5/2011 | Domke et al. | |
| 2012/0000857 | A1 | 1/2012 | Domke et al. | |

FOREIGN PATENT DOCUMENTS

| | | |
|---|---|---|
| DE | 195 16 323 | 11/1996 |
| EP | 1 316 599 | 6/2003 |
| WO | 02 066168 | 8/2002 |
| WO | 2005 076938 | 8/2005 |
| WO | WO 2005076938 A2 * | 8/2005 |

OTHER PUBLICATIONS

U.S. Appl. No. 13/117,799, filed May 27, 2011, Michailovski, et al.
U.S. Appl. No. 13/047,156, filed Mar. 14, 2011, Michailovski, et al.
Louai, A. et al., "Effect of Additives on Solution Properties of Ethylene Oxide-Propylene Oxide Statistical Copolymers", Polymer, vol. 32, No. 4, pp. 713-720, XP024118887, ISSN: 0032-3861, (Jan. 1, 1991).
Gray, S. R. et al., "Recovery of Fine Gold Particles by Flocculation with Hydrophobic Magnetite", Extractive Metallurgy Conference, pp. 223-226, (Oct. 2-4, 1991).
Li, J. et al., "Thermo-Sensitive Polymers for Controlled-Release Drug Delivery Systems", International Journal of Pharmacology, vol. 2, No. 5, pp. 513-519, ISSN 1811-7775 (2006).
Crespy, D. et al., "Temperature-Responsive Polymers with LCST in the Physiological Range and Their Applications in Textiles", Polymer International, vol. 56, No. 12, pp. 1461-1468 ( Apr. 13, 2007).
International Search Report issued Nov. 12, 2009 in PCT/EP09/059215 filed Jul. 17, 2009.
U.S. Appl. No. 13/139,091, filed Jun. 10, 2011, Domke, et al.
U.S. Appl. No. 13/203,575, filed Aug. 26, 2011, Domke, et al.
U.S. Appl. No. 13/203,579, filed Aug. 26, 2011, Domke, et al.

* cited by examiner

*Primary Examiner* — Terrell Matthews
(74) *Attorney, Agent, or Firm* — Oblon, Spivak, McClelland, Maier & Neustadt, L.L.P.

(57) ABSTRACT

The present invention relates to a process for separating at least one first material from a mixture comprising this at least one first material and at least one second material, which comprises the following steps:

(A) contacting of the mixture comprising the at least one first material and at least one second material with at least one selective hydrophobicizing agent in the presence of a suspension medium so that an adduct is formed from the at least one hydrophobicizing agent and the at least one first material but not with the at least one second material, (B) contacting of the adduct from step (A) with at least one magnetic particle which is functionalized on the surface with at least one polymeric compound having a transition temperature LCST (lower critical solution temperature) at a temperature at which the polymeric compound has hydrophobic character so that the adduct from step (A) and the at least one functionalized magnetic particle agglomerate, (C) if appropriate addition of further suspension medium to the mixture obtained in step (B), (D) separation of the agglomerate present in the suspension from step (B) or (C) from the suspension by application of a magnetic field, (E) dissociation of the agglomerate separated off in step (D) by setting of a temperature at which the polymeric compound has hydrophilic character in order to obtain the at least one first material.

18 Claims, No Drawings

INORGANIC PARTICLES COMPRISING AN ORGANIC COATING THAT CAN BE HYDROPHILICALLY/HYDROPHOBICALLY TEMPERATURE CONTROLLED

The present invention relates to a process for separating at least one first material from a mixture comprising this at least one first material and at least one second material, in which the mixture to be separated is firstly brought into contact with at least one selective hydrophobicizing agent so that an adduct is formed from the at least one hydrophobicizing agent and the at least one first material, this adduct is then brought into contact with at least one magnetic particle functionalized on the surface with at least one polymeric compound having an LCST (lower critical solution temperature) at a temperature at which the polymeric compound has hydrophobic character so that the adduct and the at least one functionalized magnetic particle agglomerate, this agglomerate is separated off by application of a magnetic field and the agglomerate is subsequently dissociated by setting a temperature at which the polymeric compound has hydrophilic character.

For the purposes of the present invention, "hydrophobic" means that the surface of a corresponding "hydrophobic substance" or a "hydrophobicized substance" has a contact angle of >90° with water against air. For the purposes of the present invention, "hydrophilic" means that the surface of a corresponding "hydrophilic substance" has a contact angle of <90° with water against air.

The process of the invention enables mixtures of materials, for example ores, to be separated by treating the materials to be separated off, for example sulfidic compounds, with a selective hydrophobicizing agent in order to hydrophobicize them on the surface. These hydrophobicized materials can then be separated off with the aid of magnetic particles which are functionalized on the surface with a polymeric compound which has an LCST. These polymeric compounds have hydrophobic character above the LCST and hydrophilic character below the LCST, or vice versa. When these polymeric compounds or magnetic particles which are functionalized on the surface with these polymeric compounds are heated, a change from the hydrophilic character of the polymeric compound to hydrophobic character, or conversely a change from hydrophobic character to hydrophilic character, occurs at the LCST. If the hydrophobicized material and the switchably functionalized magnetic particles are brought together at a temperature at which the polymeric compound has hydrophobic character, formation of an agglomerate of functionalized magnetic particle and hydrophobicized material occurs. This agglomerate can then be separated off by application of a magnetic field. Subsequent dissociation of the agglomerate can be carried out by bringing it to a temperature at which the polymeric compound has hydrophilic character, so that hydrophobic interactions between functionalized magnetic particle and hydrophobicized material are no longer possible.

In particular, the present invention relates to a process for enriching ores in the presence of the gangue.

Processes for separating ores from mixtures comprising these by means of magnetic particles are already known from the prior art.

WO 02/0066168 A1 relates to a process for separating ores from mixtures comprising these, in which suspensions or slurries of these mixtures are treated with particles which are magnetic and/or floatable in aqueous solutions. After addition of the magnetic and/or floatable particles, a magnetic field is applied so that the agglomerates are separated off from the mixture. However, the degree to which the magnetic particles are bound to the ores and the strength of the bond is not sufficient to carry out the process with satisfactory yield and effectiveness.

U.S. Pat. No. 4,657,666 discloses a process for the enrichment of ores, in which the ore present in the gangue is reacted with magnetic particles, so that agglomerates are formed as a result of the hydrophobic interactions. The magnetic particles are hydrophobicized on the surface by treatment with hydrophobic compounds, so that bonding to the ore occurs. The agglomerates are then separated off from the mixture by means of a magnetic field. The document mentioned also discloses that the ores are treated with a surface-activating solution of 1% of sodium ethylxanthogenate before the magnetic particle is added. Separation of ore and magnetic particle is in this process effected by destruction of the surface-activating substance which has been applied in the form of the surface-activating solution to the ore. A disadvantage of this process is that a surface-activating substance whose degradation products remain in the ore and may adversely affect further processing steps may be added.

U.S. Pat. No. 4,834,898 discloses a process for separating off nonmagnetic materials by bringing these into contact with magnetic reagents which are enveloped by two layers of surface-active substances. The bonding of the magnetic reagents which have been modified in this way to the nonmagnetic particles is based on interaction of the coating of the magnetic particles with the nonmagnetic materials. A disadvantage of this process is that the magnetic particles have to be provided with two layers of surface-active substances in a complicated fashion in order to achieve coupling.

S. R. Gray, D. Landberg, N. B. Gray, Extractive Metallurgy Conference, Perth, 2-4 Oct. 1991, pages 223-226, disclose a process for recovering small gold particles by bringing the particles into contact with magnetite. Before contacting, the gold particles are treated with potassium amylxanthogenate. A method of separating the gold particles from at least one hydrophilic material is not disclosed in this document.

Li et al., International Journal of Pharmacology (2006), 2(5), 513-519, disclose thermosensitive polymers which below the lower critical solution temperature (LCST) are present in homogeneous solution while when this temperature is exceeded, a heterogeneous two-phase mixture is formed. Furthermore, uses of these polymers for the controlled release of medicaments are disclosed.

Crespy et al., Polymer International (2007), 56(12), 1461-1468, likewise disclose polymers which display hydrophilic or hydrophobic behavior as a function of the ambient temperature. Furthermore, the use of these polymers in textiles and for the controlled release of pharmaceutically active substances is disclosed.

None of the documents mentioned discloses that polymers having an LCST can be used for the separation of materials.

It is an object of the invention to provide a process by means of which the at least one first material can be separated off efficiently from mixtures comprising this at least one first material and at least one second material. A further object of the present invention is to provide a process in which it is possible for the agglomerate of magnetic particle and first material to be separated off which is formed as an intermediate to be redissociated easily and very completely. Furthermore, the bond between first material to be separated off and magnetic particle should be sufficiently stable to ensure a high yield of the first material in the separation.

The objects are achieved by the process of the invention for separating at least one first material from a mixture comprising this at least one first material and at least one second material, which comprises the following steps:

(A) contacting of the mixture comprising the at least one first material and at least one second material with at least one selective hydrophobicizing agent in the presence of a suspension medium so that an adduct is formed from the at least one hydrophobicizing agent and the at least one first material but not with the at least one second material, (B) contacting of the adduct from step (A) with at least one magnetic particle which is functionalized on the surface with at least one polymeric compound having a transition temperature LCST (lower critical solution temperature) at a temperature at which the polymeric compound has hydrophobic character so that the adduct from step (A) and the at least one functionalized magnetic particle agglomerate, (C) if appropriate addition of further suspension medium to the mixture obtained in step (B), (D) separation of the agglomerate present in the suspension from step (B) or (C) from the suspension by application of a magnetic field, (E) dissociation of the agglomerate separated off in step (D) by setting of a temperature at which the polymeric compound has hydrophilic character in order to obtain the at least one first material.

The at least one first material and the at least one second material can be separated from one another by the process of the invention since, according to the invention, at least one functionalized magnetic particle which can be switched between hydrophobic and hydrophilic is added to the mixture under conditions under which an agglomerate which can be separated off by application of a magnetic field is formed from the at least one first hydrophobicized material and the at least one functionalized magnetic particle.

The process of the invention is generally employed for separating at least one first material from a mixture comprising this at least one first material and at least one second material. Apart from these components, the mixture can further comprise additional materials.

In a preferred embodiment, the at least one first material is selected from the group consisting of sulfidic ores, oxidic and/or carbonate-comprising ores and mixtures thereof.

The at least one first material to be separated off is thus preferably a metal compound selected from the group consisting of sulfidic ores, oxidic and/or carbonate-comprising ores, for example azurite $[Cu_3(CO_3)_2(OH)_2]$ or malachite $[Cu_2[(OH)_2CO_3]]$. Furthermore, the at least one material to be separated off can be selected from the group consisting of the noble metals and their compounds, for example Au, Pt, Pd, Rh, etc, preferably in the native state.

Examples of sulfidic ores which can be used for the purposes of the invention are selected from the group consisting of sulfidic colored metal ores, for example copper ores such as covellite CuS, chalcopyrite (copper pyrite) $CuFeS_2$, bornite $Cu_5FeS_4$, chalcocite (copper glance) $Cu_2S$ or mixtures thereof, molybdenum ores such as molybdenum(IV) sulfide (molybdite) $MoS_2$, iron sulfides such as $FeS/FeS_2$, nickel ores such as NiS, lead ores such as PbS, zinc ores such as ZnS or mixtures thereof.

The at least one second material is preferably selected from the group consisting of oxidic metal and semimetal compounds, hydroxidic metal and semimetal compounds and mixtures thereof, for example silicon dioxide $SiO_2$, silicates, aluminosilicates, for example feldspars $(Ba, Ca, Na, K, NH_4)(Al, B, Si)_4O_8$, for example albite $Na(Si_3Al)O_8$ or anorthite $(CaAl_2Si_2O_8)$, olivines $(Mg, Fe)_2SiO_4$, mica, for example muscovite $KAl_2[(OH,F)_2AlSi_3O_{10}]$, garnets $(X_3Y_2(SiO_4)_3$ where X=Mg, Ca, Fe(II), Mn(II) and Y=Al, Fe(III), Cr(III), Ti(III), V(III)), FeO(OH), $FeCO_3$ and further related minerals and mixtures thereof. Furthermore, oxidic compounds of metals and semimetals, for example borates or other salts of metals and semimetals, for example phosphates, sulfates or oxides/hydroxides/carbonates and further salts, can be present in the ore mixtures to be treated according to the invention, for example azurite $[Cu_3(CO_3)_2(OH)_2]$, malachite $[Cu_2[(OH)_2(CO_3)]]$, barite $(BaSO_4)$, monazite $((Ce, La, Nd)[PO_4])$.

The process of the invention is preferably carried out using untreated ore mixtures which are obtained from mine deposits.

In a preferred embodiment of the process of the invention, the mixture comprising at least one first material and at least one second material in step (A) is in the form of particles having a size of from 100 nm to 100 μm, see, for example, U.S. Pat. No. 5,051,199. In a preferred embodiment, this particle size is obtained by milling. Suitable processes and apparatuses are known to those skilled in the art, for example wet milling in a ball mill.

In a preferred embodiment of the process of the invention, the mixture comprising at least one first material and at least one second material is milled to particles having a size of from 100 nm to 500 μm, preferably from 100 nm to 100 μm, before or during step (A).

Preferred ore mixtures have a very high content of sulfidic minerals. A typical ore mixture which can be separated by the process of the invention has the following composition: about 30% by weight of $SiO_2$, about 10% by weight of $Na(Si_3Al)O_8$, about 3% by weight of $Cu_2S$, about 1% by weight of $MoS_2$, balance chromium, iron, titanium and magnesium oxides.

The individual steps of the process of the invention are described in detail below:

Step (A):

Step (A) of the process of the invention comprises contacting of the mixture comprising the at least one first material and at least one second material with at least one selective hydrophobicizing agent in a suitable suspension medium so that an adduct is formed from the at least one hydrophobicizing agent and the at least one first material but not with the at least one second material.

The first step of the process of the invention serves to hydrophobicize the at least one first material on the surface so that it agglomerates with the at least one functionalized magnetic particle in the subsequent step (B).

Methods of hydrophobicizing the surface of the at least one first material are known to those skilled in the art.

For the purposes of the present invention, a "hydrophobicizing agent" is a substance which is able to hydrophobicize the surface of the at least one first material in the presence of the other particles which are not to be separated off, i.e. modify it in such a way that the surface of the hydrophobicized at least one first material has a contact angle of >90° with water against air.

For the purposes of the present invention, "selectively" means that the partition coefficient of the hydrophobicizing agent between the surface of the at least one first material and the surface of the at least one second material is generally >1, preferably >100, particularly preferably >10 000, i.e. the hydrophobicizing agent preferentially becomes attached to the surface of the at least one first material and not to the surface of the at least one second material.

In the process of the invention, preference is given to using at least one hydrophobicizing agent of the general formula (I)

$$A—(Z)_x \quad (I)$$

which binds to the at least one first material, where

A is selected from among linear or branched $C_3$-$C_{30}$-alkyl, $C_3$-$C_{30}$-heteroalkyl, optionally substituted $C_6$-$C_{30}$-aryl, optionally substituted $C_6$-$C_{30}$-heteroalkyl, $C_6$-$C_{30}$-aralkyl, Z is a group by means of which the compound of the general formula (I) binds to the at least one first material and x is 1, 2 or 3.

In a particularly preferred embodiment, A is a linear or branched $C_6$-$C_{16}$-alkyl, for example 2-propylheptyl. Heteroatoms which may be present according to the invention are selected from among N, O, P, S and halogens such as F, Cl, Br and I.

In a further particularly preferred embodiment, Z is selected from the group consisting of anionic groups $—(X)_n—PO_3^{2-}$, $—(X)_n—PO_2S^{2-}$, $—(X)_n—POS_2^{2-}$, $—(X)_n—PS_3^{2-}$, dithiophosphinate $[—(X)_n]_2PS_2^-$, $—[(X)_n]_2POS^-$, dithiophosphate $[—(X)_n]_2PO_2^-$, $—(X)_n—CO_2^-$, $—(X)_n—CS_2^-$, $—(X)_n—COS^-$, $—(X)_n—C(S)NHOH$, $—(X)_n—S^-$ where X is selected from the group consisting of O, S, NH, $CH_2$ and n=0, 1 or 2, if appropriate with cations selected from the group consisting of hydrogen, $NR_4^+$ where the radicals R are each, independently of one another, hydrogen or $C_1$-$C_8$-alkyl, alkali metals or alkaline earth metals. According to the invention, the anions mentioned and the corresponding cations form uncharged compounds of the general formula (I). In the case of dithiophosphinate $[—(X)_n]_2PS_2^-$, $—[(X)_n]_2POS^-$ or dithiophosphate $[—(X)_n]_2PO_2^-$, there are two radicals A bound to these functional groups; these radicals A have the meanings given above for A and can be identical or different, preferably identical, and are preferably selected from among $C_6$-$C_{30}$, particularly preferably $C_6$-$C_{16}$-alkyl.

In a very particularly preferred embodiment of the process of the invention, Z is $[—(X)_n]_2PS_2^-$, $—(X)_n—CS_2^-$, $—[(X)_n]_2PO_2^-$ or $—(X)_n—S^-$ where X is O and n is 0 or 1, and a cation selected from among hydrogen, sodium or potassium.

In the case of noble metals, for example Au, Pd, Rh etc., particularly preferred hydrophobicizing agents are monothiols, dithiols and trithiols or 8-hydroxyquinolines, for example as described in EP 1200408 B1.

In the case of metal oxides, for example FeO(OH), $Fe_3O_4$, ZnO etc., carbonates, for example azurite $[Cu(CO_3)_2(OH)_2]$, malachite $[Cu_2[(OH)_2CO_3]]$, particularly preferred hydrophobicizing agents are $C_6$-$C_{16}$-alkylphosphonic acids, for example octylphosphonic acid (OPS), monoalkyl and dialkyl esters of phosphoric acid having a $C_6$-$C_{20}$-alkyl radical, hydroxamates and also long-chain carboxylic acids (fatty acids).

In the case of metal sulfides, for example $Cu_2S$, $MoS_2$, etc., particularly preferred hydrophobicizing agents are monothiols, dithiols and trithiols, xanthogenates, dithiophosphinates or mono-, di- or tri-$C_6$-$C_{30}$-alkyl esters of the thiophosphoric acids of the general formula (VII)

(VI)

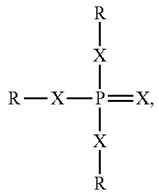

where the radicals R are each, independently of one another, hydrogen or $C_6$-$C_{30}$-alkyl and the radicals X are each, independently of one another, S or O, where from one to three of the radicals X present are S and the remaining radicals are O.

Very particularly preferred surface-active substances are 1-octanethiol, potassium octylxanthate, octylphosphonic acid, monooctyl phosphate or a compound of the general formula (IV)

(IV)

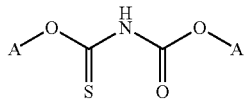

with the abovementioned meanings for A.

The contacting in step (A) of the process of the invention can be effected by all methods known to those skilled in the art. For example, the mixture to be treated, the at least one hydrophobicizing agent and the suspension medium are combined in the appropriate amounts and mixed. Mixing can, for example, be effected by wet milling. Suitable mixing apparatuses are known to those skilled in the art, for example mills such as ball mills.

In step (A), the suspension medium is generally added in such an amount that the suspension obtained has a solids content of from 0.1 to 80% by weight, preferably from 20 to 40% by weight.

In general, it is possible to use all suspension media which are known to be suitable by those skilled in the art in the process of the invention, i.e. suspension media in which the mixture as per step (A) is not completely soluble. In a preferred embodiment, the suspension medium is an aqueous mixture, i.e. a mixture comprising at least 80% by weight, preferably at least 95% by weight, of water. In a particularly preferred embodiment, the suspension medium in step (A) is water.

The suspension medium can comprise not only water but also further components, for example components selected from the group consisting of water-soluble organic compounds such as alcohols having from 1 to 4 carbon atoms, ketones such as acetone and mixtures thereof, soluble salts such as NaCl, KCl, $MgCl_2$, $CaCl_2$, $Na_2CO_3$, $K_2CO_3$, $MgCO_3$, inorganic acids and bases such as NaOH, KOH, $Ca(OH)_2$, HCl, $H_2SO_4$, $HNO_3$, organic acids and bases such as formic acid or acetic acid, etc.

Step (A) of the process of the invention is generally carried out at a temperature of from 1 to 80° C., preferably from 40 to 60° C.

The at least one hydrophobicizing agent is generally added in an amount which is sufficient to achieve the desired effect. In a preferred embodiment, the at least one hydrophobicizing agent is added in an amount of from 0.01 to 5% by weight, in each case based on the at least one first material present in the mixture.

According to the invention, a mixture comprising an adduct of at least one first material and at least one hydrophobicizing agent together with at least one second material is present in suspension after step (A).

Step (B):

Step (B) of the process of the invention comprises contacting of the adduct from step (A) with at least one magnetic particle which is functionalized on the surface with at least one polymeric compound having a transition temperature LCST (lower critical solution temperature) at a temperature at which the polymeric compound has hydrophobic character so that the adduct from step (A) and the at least one functionalized magnetic particle agglomerate.

As magnetic particles, it is generally possible to use all magnetic particles which are known to those skilled in the art and satisfy the requirements of the process of the invention, for example suspendability in any suspension medium used and the ability to be functionalized with the at least one polymeric compound.

Furthermore, the magnetic particle should have a sufficiently high saturation magnetizability, for example 25-300 emu/g, and a low remanence so that the adduct can be separated off in sufficient amount from the suspension in step (D) of the process of the invention.

In a preferred embodiment, the at least one magnetic particle is selected from the group consisting of magnetic metals, for example iron, cobalt, nickel and mixtures thereof, ferromagnetic alloys of magnetic metals, magnetic iron oxides, for example magnetite, maghemite, cubic ferrites of the general formula (II)

$$M^{2+}{}_{x}Fe^{2+}{}_{1-x}Fe^{3+}{}_{2}O_{4} \quad \text{(II)}$$

where

M is selected from among Co, Ni, Mn, Zn and mixtures thereof and $x \leqq 1$, hexagonal ferrites, for example barium or strontium ferrite $MFe_{12}O_{19}$ where M=Ca, Sr, Ba, and mixtures thereof.

In a particularly preferred embodiment of the present application, the at least one magnetic particle is magnetite $Fe_3O_4$ or cobalt ferrite $Co^{2+}{}_{x}Fe^{2+}{}_{1-x}Fe^{3+}{}_{2}O_4$ where $x \leqq 1$, for example $Co_{0.25}Fe_{2.75}O_4$.

The size of the magnetic particles used according to the invention is preferably from 10 nm to 1 μm.

The at least one magnetic particle is functionalized on the surface with at least one polymeric compound. The polymeric compounds used according to the invention have a transition temperature LCST (lower critical solution temperature). Below this LCST, the polymeric compound has hydrophilic character since the polymer chain has, for example, a hydration shell as a result of attachment of water molecules. Above the LCST, the polymeric compound has hydrophobic character since the polymer chain is, for example, no longer surrounded by a hydration shell. Depending on the polymeric compound, the reverse case, namely that the polymeric compound has hydrophobic character below the LCST and has hydrophilic character above the LCST, is also possible. If such a polymeric compound is heated from below the LCST to a temperature above the LCST, the polymeric compound switches from hydrophilic to hydrophobic, or vice versa, at the LCST. The polymers which can be used according to the invention therefore have hydrophilic or hydrophobic character depending on the temperature.

The change of the polymeric compound from hydrophobic to hydrophilic or vice versa corresponds to a phase change which in a closed system generally takes place in a narrow temperature range of, for example, 0.5° C. In an open system, the phase change can extend over a broader range of, for example, 15° C., for example as a result of a change in the concentration of the components present, for example polymers and/or foreign substances, or variation of the pH and/or the pressure. The temperature range in which the change proceeds to completion is generally greater the longer the chain length. During the change in the molecular properties from hydrophilic to hydrophobic, some water molecules generally initially remain attached to the polymer and are gradually liberated. This process is generally completely reversible as long as the polymeric compound is not chemically modified, for example by increasing the pH.

The properties described for the polymeric compounds which can be used according to the invention are also essentially present correspondingly in the particles modified with these polymeric compounds, in particular magnetic particles.

In a preferred embodiment of the process of the invention, the polymeric compound is hydrophobic above the LCST and hydrophilic below the LCST.

According to the invention, it is possible to use all polymeric compounds which have an LCST, i.e. have hydrophilic or hydrophobic character at various temperatures. For the purposes of the present invention, a "polymer" is a preferably organic compound having a molecular weight of at least 500 g/mol, preferably from 500 to 10 000 g/mol, particularly preferably from 1000 to 7000 g/mol.

In a preferred embodiment of the process of the invention, the at least one polymeric compound is selected from the group consisting of polyvinyl ethers, for example polyvinyl methyl ether, poly-N-alkylacrylamides, for example poly-N—$C_1$-$C_6$-alkylacrylamides, in particular poly-N-isopropylacrylamide, and N-alkylacrylamide-acrylamide copolymers, poly-N-vinylcaprolactams, copolymers based on alkylene oxides, for example copolymers of ethylene oxide, propylene oxide and/or butylene oxide, preferably polymeric compounds obtainable by alkoxylation of $C_1$-$C_{12}$-alcohols with from 1 to 130 units of ethylene oxide, propylene oxide and/or butylene oxide, and mixtures thereof. Suitable polymeric compounds and processes for preparing them are described, for example, in Li et al., International Journal of Pharmacology (2006), 2(5), 513-519, and Crespy et al., Polymer International (2007), 56(12), 1461-1468. These polymeric compounds have hydrophilic character below the LCST and hydrophobic character above the LCST.

The abovementioned polymeric compounds which have an LCST are, according to the invention, bound via functional groups to the appropriate magnetic particles. These functional groups can be present in the abovementioned polymeric compounds themselves or the functional groups can be introduced into the polymeric compounds by methods known to those skilled in the art, i.e. the polymeric compounds are functionalized. Suitable functional groups are those which ensure a sufficiently strong bond between magnetic particle and polymeric compound, for example groups selected from the group consisting of the thiol group —SH, the carboxyl group —$CO_2H$, the optionally at least partly esterified phosphonic acid group —$PO_3R'_2$ where R' is hydrogen or $C_1$-$C_6$-alkyl (Va), the optionally at least partly esterified phosphoric acid group —O—$PO_3R''_2$ where R" is hydrogen or $C_1$-$C_6$-alkyl (Vb), the hydroxamate group (Vc), the xanthogenate group (Vd)

(Va)

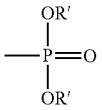

(Vb)

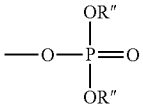

(Vc)

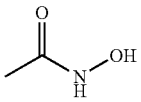

(Vd)

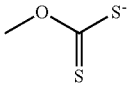

and mixtures thereof, particularly preferably groups selected from the group consisting of the thiol group —SH, the carboxyl group —$CO_2H$, the optionally at least partly esterified phosphonic acid group —$PO_3R'_2$ where R' is hydrogen or $C_1$-$C_6$-alkyl (Va), the optionally at least partly esterified phosphoric acid group —O—$PO_3R''_2$ where R" is hydrogen or $C_1$-$C_6$-alkyl (Vb), the hydroxamate group (Vc). The xanthogenate group (Vd) is preferably suitable for coupling to sulfidic compounds.

In a preferred embodiment, the at least one polymeric compound is at least one functionalized copolymer of ethylene oxide, propylene oxide and/or butylene oxide, particularly preferably a compound of the general formula (III)

$$F\text{-}[(EO)_x\text{—}(PO)_y\text{—}(BuO)_z]\text{—}B \quad \text{(III)}$$

where

F is a functional group which binds selectively to the at least one magnetic particle, B is an alkyl radical having from 1 to 6 carbon atoms, EO is ethylene oxide, PO is propylene oxide, BuO is butylene oxide, x is an integer or fraction from 0 to 130, preferably from 0 to 40 y is an integer or fraction from 0 to 130, preferably from 1 to 35, and z is an integer or fraction from 0 to 130, preferably from 0 to 40, where $1 \leqq x+y+z \leqq 130$, preferably $10 \leqq x+y+z \leqq 130$.

In the compound of the general formula (III), F is a functional group which binds selectively to the at least one magnetic particle. The choice of this functional group depends on the at least one magnetic particle to which the functional group is to bind. A dissociation-stable bond between the at least one magnetic particle and the at least one polymeric compound of the general formula (III) should preferably be formed.

In a preferred embodiment, F is selected from the group consisting of the carboxyl group —$CO_2H$, the optionally at least partly esterified phosphonic acid group —$PO_3R'_2$ where R' is hydrogen or $C_1$-$C_6$-alkyl (Va), the optionally at least partly esterified phosphoric acid group —O—$PO_3R''_2$ where R" is hydrogen or $C_1$-$C_6$-alkyl (Vb), the hydroxamate group (Vc), the xanthogenate group (Vd)

(Va)

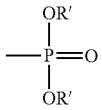

(Vb)

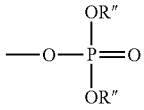

(Vc)

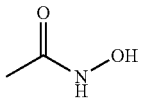

(Vd)

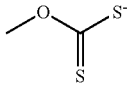

and mixtures thereof, particularly preferably an optionally at least partly esterified phosphonic acid group (Va) or an optionally at least partly esterified phosphoric acid group (Vb).

The functional groups Va to Vd are preferably bound to the polymer via free electron pairs.

In the general formula (III), B is an alkyl radical having from 1 to 6 carbon atoms, for example methyl, ethyl, propyl, butyl, for example n-butyl, pentyl, hexyl.

The polymeric compounds of the general formula (III) have an LCST which generally depends in each case on the amount of the individual alkylene oxides, i.e. ethylene oxide, propylene oxide and/or butylene oxide, in the polymer. A polymeric compound which is made up exclusively of propylene oxide has, for example, an LCST of <−10° C. A polymeric compound which is made up exclusively of ethylene oxide, has, for example, an LCST of >120° C. Selection of the type and amount of the alkylene oxides thus makes it possible to set an LCST of the polymeric compound which is suitable for the process of the invention.

In a preferred embodiment, the LCST of the polymeric compound used in the process of the invention is from −10 to 100° C., particularly preferably from 5 to 45° C., very particularly preferably from 20 to 40° C. The LCST of a polymeric compound is generally in the temperature range from about 5 to 15° C. The breadth of this range generally depends on the uniformity, i.e. the monodispersity, of the polymeric compound used. The higher the monodispersity, the narrower the range of the LCST.

Processes for preparing polymeric compounds of the general formula (III) are known to those skilled in the art.

The functionalization of the at least one magnetic particle with the at least one polymeric compound can be carried out by all methods known to those skilled in the art. In a preferred embodiment, the at least one magnetic particle is functionalized with the at least one polymeric compound by firstly producing the magnetic particle itself by known methods. This magnetic particle is then modified by bringing it into contact with a solution of the functionalized polymeric compound, in particular compounds of the general formula (III), in water or in an organic solvent, for example low molecular weight alcohols or ketones, and the product obtained is washed with an appropriate solvent to remove excess polymeric compound.

The contacting of the adduct from step (A) with at least one functionalized magnetic particle in step (B) can be effected by all methods known to those skilled in the art. In a preferred embodiment, the at least one functionalized magnetic particle is added to the mixture from step (A). In a preferred embodiment, step (B) is carried out in a mill, particularly preferably in the same mill in which step (A) has been carried out. The heat produced during milling of the components in step (B) is preferably used for achieving the temperature in the mixture necessary for step (A), preferably for the case where the polymeric compound is hydrophobic above its LCST.

Step (B) of the process of the invention is carried out at a temperature at which the polymeric compound used has hydrophobic character so that the switchably functionalized magnetic particle and the hydrophobicized at least one first material agglomerate. Depending on the polymeric compound, this temperature can be above or below the LCST, with preference being given to the temperature being above the LCST.

Step (B) is preferably carried out at a temperature which is greater than the LCST of the polymeric compound and lower than the boiling point of the suspension medium used. Step (B) is particularly preferably carried out at a temperature which is from 1 to 20° C. above the LCST. In a preferred embodiment, step (B) is thus carried out at a temperature of from 6 to 65° C., particularly preferably from 21 to 60° C.

When the polymeric compound has hydrophobic character below the LCST, step (B) of the process of the invention is carried out at a temperature which is above the melting point of the suspension medium used and below the LCST of the polymeric compound. In this case, step (B) is preferably carried out at a temperature which is from 1 to 20° C. below the LCST. Step (B) is in this case therefore preferably carried out at a temperature of from −15 to 44° C., particularly preferably from 0 to 39° C.

Step (B) of the process of the invention is preferably carried out for such a time that a sufficient amount of agglomerate of at least one hydrophobicized first material and switchably functionalized magnetic particle is formed, for example to a proportion of from 80 to 100%, preferably quantitatively (100%).

After step (B) of the process of the invention, agglomerates of magnetic particle functionalized on the surface with at least one polymeric compound and at least one hydrophobicized first material together with at least one second material and possibly other materials are present in a suspension medium.

Step (C)

The optional step (C) of the process of the invention comprises (C) the addition of further suspension medium to the mixture obtained in step (B).

Step (C) is preferably carried out when the suspension prepared in step (A) has a solids content which is too high for the subsequent steps (D) and (E), so that, for example, the mobility of the agglomerates formed in step (B) in the suspension is insufficient.

In step (C) of the process of the invention, all suspension media which have been mentioned above with regard to step (A) are suitable as suspension medium. In a preferred embodiment, an aqueous mixture, i.e. a mixture comprising at least 80% by weight, preferably at least 95% by weight, of water is used in step (C). The aqueous mixture can additionally comprise the components mentioned with regard to step (A). In particularly preferred embodiment, water is added in step (C) of the process of the invention.

Step (C) of the process of the invention is generally carried out at a temperature at which the agglomerate of at least one hydrophobicized material and the functionalized magnetic particle formed in step (B) is not dissociated.

Step (C) is thus carried out at a temperature which is greater than the LCST of the polymeric compound and lower than the boiling point of the suspension medium used. Step (C) is particularly preferably carried out at a temperature which is from 1 to 20° C. above the LCST. In a preferred embodiment, step (C) is thus carried out at a temperature of from 6 to 65° C., particularly preferably from 21 to 60° C.

When the polymeric compound has hydrophobic character below the LCST, step (C) of the process of the invention is carried out at a temperature which is above the melting point of the suspension medium used and below the LCST of the polymeric compound. In this case, step (C) is preferably carried out at a temperature which is from 1 to 20° C. below the LCST. Step (C) is in this case thus preferably carried out at a temperature of from −15 to 44° C., particularly preferably from 0 to 39° C.

In general, the amount of suspension medium can, according to the invention, be chosen so that a suspension which is readily stirrable and/or conveyable is obtained in step (C). In a preferred embodiment, a suitable suspension medium is added so that a solids content of the resulting suspension of from 0.1 to 80% by weight, particularly preferably from 0.1 to 40% by weight, results.

Step (D)

Step (D) of the process of the invention comprises separation of the agglomerate present in the suspension from step (B) or (C) from the suspension by application of a magnetic field.

Step (D) can, in a preferred embodiment, be carried out by introducing a permanent magnet into the reactor in which the suspension from step (B) or (C) is present. In a preferred embodiment, a dividing wall composed of nonmagnetic material, for example the wall of the reactor, is located between permanent magnetic and mixture to be treated. In a further preferred embodiment of the process of the invention, an electromagnet which is only magnetic when an electric current flows is used in step (D). Suitable apparatuses are known to those skilled in the art.

Step (D) of the process of the invention is generally carried out at a temperature at which the agglomerate of at least one hydrophobicized material and the functionalized magnetic particle formed in step (B) is not dissociated.

Step (D) is thus preferably carried out at a temperature which is greater than the LCST of the polymeric compound and lower than the boiling point of the suspension medium used. Step (D) is particularly preferably carried out at a temperature which is from 1 to 20° C. above the LCST. In a preferred embodiment, step (D) is thus carried out at a temperature of from 6 to 65° C., particularly preferably from 21 to 60° C.

When the polymeric compound has hydrophobic character below the LCST, step (D) of the process of the invention is carried out at a temperature which is above the melting point of the suspension medium used and below the LCST of the polymeric compound. In this case, step (D) is preferably carried out at a temperature which is from 1 to 20° C. below the LCST. Step (D) is in this case thus preferably carried out at a temperature of from −15 to 44° C., particularly preferably from 0 to 39° C.

Steps (B), (C) and (D) can be carried out at the same temperature, but it is also possible, according to the invention, for the steps to be carried out at different temperatures, within the ranges indicated.

During step (D), the mixture is mixed, preferably continually, by means of a suitable apparatus.

In step (D), the components remaining in the suspension after the treatment with a magnet can, if appropriate, be separated off by all methods known to those skilled in the art, for example by draining off the part of the suspension which is not held by the magnet through the bottom valve of the reactor utilized in step (D) or pumping away the part of the suspension which is not held by the at least one magnet.

After step (D) of the process of the invention, the agglomerate of at least one functionalized magnetic particle and the at least one hydrophobicized first material formed in step (B) of the process of the invention is present on the magnet or on a wall located between magnet and adduct. In the case of an electromagnet, the adduct can be removed from the magnet by switching off the electric current, so that a magnetic field gradient is no longer present. If a wall is present between the magnets and the suspension, the adduct can be removed by methods known to those skilled in the art.

Step (E)

Step (E) of the process of the invention comprises dissociation of the agglomerate separated off in step (D) by setting a temperature at which the polymeric compound has hydrophilic character in order to obtain the at least one first material.

The temperature in step (E) of the process of the invention is set as a function of whether a polymeric compound which has hydrophilic character below or above the LCST is used in the process of the invention.

In the preferred case, where the polymeric compound has hydrophilic character below the LCST, step (E) of the process of the invention is carried out at a temperature which is above the melting point of the suspension medium used and below the LCST of the polymeric compound. In this case step (E) is preferably carried out at a temperature which is from 1 to 20° C. below the LCST. Step (E) is in this case thus preferably carried out at a temperature of from −15 to 44° C., particularly preferably from 0 to 39° C.

When the polymeric compound has hydrophilic character above the LCST, step (E) is carried out at a temperature which is greater than the LCST of the polymeric compound and lower than the boiling point of the suspension medium used. Step (E) is in this case particularly preferably carried out at a temperature which is from 1 to 20° C. above the LCST. In a preferred embodiment, step (D) is thus carried out at a temperature of from 6 to 65° C., particularly preferably from 21 to 60° C.

At the temperature prevailing in step (E) of the process of the invention, the polymeric compound has hydrophilic character, i.e. no hydrophobic interactions can take place between the polymeric compound on the surface of the at least one magnetic particle and the hydrophobicized first material, so that the agglomerates are dissociated.

Step (E) of the process of the invention is carried out for such a time that the agglomerates present are substantially completely dissociated, for example to a proportion of from 70 to 99%, preferably from 80 to 98%.

After dissociation of the agglomerate, the at least one functionalized magnetic particle and the at least one hydrophobicized first material are present in suspended form. These two materials can be separated from one another and from the suspension medium by all methods known to those skilled in the art.

The at least one magnetic particle is preferably separated off from the suspension comprising this at least one magnetic particle and the at least one first material by means of a permanent magnet or electromagnet. Details of this separation are analogous to step (D) of the process of the invention. After this separation, the at least one first material is preferably present in suspended form while the at least one magnetic particle adheres to the magnet.

The first material to be separated off is preferably separated from the suspension medium by distilling off the suspension medium or filtration. The first material obtained in this way can be purified by further processes known to those skilled in the art. The suspension medium can, if appropriate after purification, be recirculated to the process of the invention. In a preferred embodiment, the at least one magnetic particle is likewise recirculated to step (A) of the process of the invention.

The present invention also provides functionalized particles of the general formula (VI)

$$P—\{F\text{-}[(EO)_x—(PO)_y—(BuO)_z]—B\}_q \quad \text{(VI)},$$

where

P is a particle comprising at least one metal or semimetal,

F is a functional group,

B is an alkyl radical having from 1 to 6 carbon atoms,

EO is ethylene oxide,

PO is propylene oxide,

BuO is butylene oxide, x is an integer or fraction from 0 to 130, preferably from 0 to 40, y is an integer or fraction from 0 to 130, preferably from 1 to 35, z is an integer or fraction from 0 to 130, preferably from 0 to 40, where $1 \leqq x+y+z \leqq 130$, preferably $10 \leqq x+y+z \leqq 130$, and q is an integer from 1 to $1*10^{15}$.

In the compound of the general formula (VI), P is generally a particle comprising at least one metal or semimetal, preferably in oxidic or sulfidic form.

Examples of particles which comprise at least one metal in oxidic form are, for example, selected from the group consisting of transition or main group metal oxides, for example CuO, ZnO, $Cr_2O_3$, $Fe_2O_3$, $TiO_2$, $SiO_2$, $CeO_2$, titanates, for example $BaTiO_3$, $SrTiO_3$, and mixtures thereof.

Examples of particles which comprise at least one metal in sulfidic form are, for example, selected from the group consisting of transition metal sulfides, for example CuS, $Zn_{1-x}Mn_xS$ where $0 \leqq x \leqq 0.22$, chalcopyrite (copper pyrite) $CuFeS_2$, bornite $Cu_5FeS_4$, chalcocyte (copper glance) $Cu_2S$ and mixtures thereof, molybdenum(IV) sulfide (molybdite) $MoS_2$, iron sulfides such as $FeS/FeS_2$, nickel sulfide such as NiS, lead sulfide such as PbS, zinc sulfide such as ZnS, CdS, CdSe, CdTe and mixtures thereof.

Examples of metals comprised in the particle P are platinum and coinage metals, e.g. copper, silver, gold, iron, cobalt, nickel and alloys thereof.

The particle P can also comprise semiconducting materials selected from the group consisting of Ge, Si, α-Sn, C, for example fullerenes, B, Se, Te, Bi, Ca, Sr, Ba, Yb, P, S, GaP, GaAs, InP, InSb, InAs, GaSb, GaN, AlN, InN, $Al_xGa_{1-x}As$ where x is from 0 to 1, ZnO, ZnS, ZnSe, ZnTe, CdS, CdSe, CdTe, $Hg_{1-x}Cd_xTe$ where x is from 0 to 1, BeSe, BeTe, HgS GaS, GaSe, GaTe, InS, InSe, InTe, $CuInSe_2$, $CuInGaSe_2$, $CuInS_2$, $CuInGaS_2$ and SiC.

In a preferred embodiment, P is a particle selected from the group of magnetic particles, in particular selected from the group consisting of magnetic metals, for example iron, cobalt, nickel and mixtures thereof, ferromagnetic alloys of magnetic metals, magnetic iron oxides, for example magnetite, maghemite, cubic ferrites of the general formula (II)

$$M^{2+}{}_xFe^{2+}{}_{1-x}Fe^{3+}{}_2O_4 \quad \text{(II)}$$

where

M is selected from among Co, Ni, Mn, Zn and mixtures thereof and $x \leqq 1$, hexagonal ferrites, for example barium or strontium ferrite $MFe_{12}O_{19}$ where M=Ca, Sr, Ba, and mixtures thereof.

In a particularly preferred embodiment of the present patent application, P is selected from the group consisting of magnetite $Fe_3O_4$, cobalt ferrite $Co^{2+}{}_xFe^{2+}{}_{1-x}Fe^{3+}{}_2O_4$ where $x \leqq 1$, for example $Co_{0.25}Fe_{2.75}O_4$, and mixtures thereof.

The size of the particle present in the adduct of the general formula (IV) according to the invention is preferably from 5 nm to 100 μm, particularly preferably from 10 nm to 50 μm.

In the general formula (VI), F is a functional group which binds, preferably selectively, to the particles P. F is, for example, selected from the group consisting of the thiol group —SH, the carboxyl group —$CO_2H$, the optionally at least partly esterified phosphonic acid group —$PO_3R'_2$ where R' is hydrogen or $C_1$-$C_6$-alkyl (Va), the optionally at least partly esterified phosphoric acid group —O—$PO_3R''_2$ where R" is hydrogen or $C_1$-$C_6$-alkyl (Vb), the hydroxamate group (Vc), the xanthogenate group (Vd)

(Va)

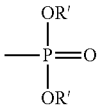

(Vb)

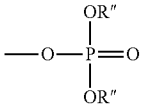

(Vc)

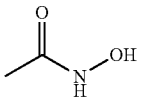

(Vd)

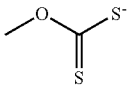

and mixtures thereof, particularly preferably an optionally at least partly esterified phosphonic acid group (Va) or an optionally at least partly esterified phosphoric acid group (Vb).

In the case of oxidic particles P, functional groups selected from among the carboxyl group —$CO_2H$, the optionally at least partly esterified phosphonic acid group —$PO_3R'_2$ where R' is hydrogen or $C_1$-$C_6$-alkyl (Va), the optionally at least partly esterified phosphoric acid group —O—$PO_3R''_2$ where R" is hydrogen or $C_1$-$C_6$-alkyl (Vb) and the hydroxamate group (Vc) are particularly useful.

In the case of sulfidic particles P, functional groups selected from among the thiol group —SH and the xanthogenate group (Vd) are particularly useful.

In the case of platinum and coinage metals, the thiol group —SH is particularly useful.

In the compound of the general formula (VI), B is an alkyl radical having from 1 to 6 carbon atoms, for example methyl, ethyl, propyl, butyl, for example n-butyl, pentyl or hexyl.

In the compound of the general formula (VI), q is an integer from 1 to $1 \cdot 10^{15}$, preferably from $1 \cdot 10^3$ to $1 \cdot 10^{12}$. In the general formula (VI), q is the number of molecules of the polymeric compound which are bound to a particle P. These values correspond to a maximum occupation density of the particle P of $1.67 \cdot 10^{-6}$ mol/m$^2$, preferably from 1 to 100% of the maximum occupation density. The number of polymer molecules bound to a particle P can be controlled via the amount of polymeric compound in the production process. The number of polymer molecules per particle P can be determined by methods known to those skilled in the art, for example elemental analysis.

Functionalized particles of the general formula (VI) can be produced by methods known to those skilled in the art, for example by contacting of a solution of the polymeric compound of the general formula (III) in water or an organic solvent, preferably water, low molecular weight alcohols or ketones, and washing of the product obtained with the corresponding solvents in order to remove excess polymeric compound.

Functionalized particles of the general formula (VI) can be used for separating at least one first material from a mixture comprising the at least one first material and at least one second material, for example by means of the process of the invention. The present invention therefore also provides for the use of a functionalized particle of the general formula (VI) for the separation of mixtures of materials. As regards the mixtures of materials and the further parameters of the materials separation, what has been said above applies.

Furthermore, a polymeric compound having a transition temperature LCST, preferably at least one polymeric compound selected from the group consisting of polyvinyl ethers, for example polyvinyl methyl ether, poly-N-alkylacrylamides, for example poly-N—$C_1$-$C_6$-alkylacrylamides, in particular poly-N-isopropylacrylamide, and N-alkylacrylamide-acrylamide copolymers, poly-N-vinylcaprolactams, copolymers based on alkylene oxides, for example copolymers of ethylene oxide, propylene oxide and/or butylene oxide, preferably polymeric compounds obtainable by alkoxylation of $C_1$-$C_{12}$-alcohols having from 1 to 130 units of ethylene oxide, propylene oxide and/or butylene oxide, and mixtures thereof, particularly preferably a compound of the general formula (III) as defined above, can also be used for separating at least one first material from a mixture comprising the at least one first material and at least one second material, for example by means of the process of the invention.

The present invention therefore also provides for the use of a polymeric compound having a transition temperature LCST, preferably a polymeric compound selected from the abovementioned group, particularly preferably a polymeric compound of the general formula (III), for the separation of mixtures of materials.

EXAMPLES

Example 1

Preparation of the Modifying Agent which can be Switched Between Hydrophilic and Hydrophobic The functionalizing agent is prepared by reacting an alkoxylate of the formula n-Bu-$(PO)_{22}$—OH (Pluriol A1350P, BASF SE) with polyphosphoric acid (from therm-Phos) using methods known to those skilled in the art. The change from hydrophilic to hydrophobic is found to take place at 15-26° C.

The alkoxylate n-Bu—$(PO)_{22}$—OH used has an OH number (OHN) of 46.3 and a molecular weight of 1213 g/mol.

Alkoxylate and polyphosphonic acid are reacted at 80° C. for 31.7 hours. After 29 hours, a conversion of 72% is determined by titration, and the acid number is 102 mg KOH/g.

Example 2

Production of the Magnetic Particle which can be Switched Between Hydrophilic and Hydrophobic A suspension of 100 mg of the product obtained in example 1 in 10 ml of water (about 10° C.) is prepared. 2 g of magnetite (Magnetic Black 345, BASF; Ø 4 μm) are stirred with the suspension for 15 minutes, filtered off, washed with 50 ml of cold water (T<10° C.) and dried at 80° C. under reduced pressure.

Example 3

Separation Experiment

A suspension of 54 g of quartz flour ($SiO_2$, Microsil grade S8 from Euroquarz), 2 g of $Cu_2S$, (325 mesh, Aldrich) and 1000 g of processed water is placed in a glass beaker and stirred. 0.13 g of potassium 1-octylxanthate and 0.08 g of Shellsol 40 are added to the suspension. The suspension is stirred by means of a propeller stirrer (35 rpm) for 1 hour and subsequently heated to 45° C. while stirring. 2 g of the magnetite which can be switched between hydrophilic and hydrophobic from example 2 are added while stirring. The suspension is stirred at 45° C. for a further 30 minutes.

The suspension is subsequently conveyed past a plurality of permanent magnets behind glass. The magnetic constituents are held by the magnets and the remainder of the suspension is collected, filtered, the solid is dried and analyzed to determine the Cu content (fraction A1).

The magnetic constituents are, after removal of the permanent magnets, suspended in cold water (10° C.) and once again conveyed past the magnets. The output is collected, filtered, the solid is dried and analyzed to determine the Cu content (fraction A2).

The fraction held on the magnets is examined in the same way (fraction R). It is found that the total amount of copper found (=100% by weight) is divided among the fractions as follows:

| A1 | A2 | R |
|---|---|---|
| 15.5% by weight | 39.5% by weight | 45.0% by weight |

In contrast, 95% of the quartz flour used can be found in the fraction A1. A clear enrichment of the copper in the fraction A2 has therefore occurred.

The invention claimed is:

1. A process for separating at least one first material from a mixture comprising the at least one first material and at least one second material, the process comprising:

(A) contacting the mixture comprising:

(a1) the at least one first material selected from the group consisting of a sulfidic ore, an oxidic ore, a carbonate-comprising ore, and an oxidic- and carbonate-comprising ore, and (a2) the at least one second material, with at least one selective hydrophobicizing agent in the presence of a suspension medium, so that an adduct is formed from the at least one hydrophobicizing agent and the at least one first material but not with the at least one second material, (B) contacting the adduct from (A) with at least one magnetic particle which is functionalized on a surface with at least one polymeric compound having a transition temperature LCST, lower critical solution temperature, at a temperature at which the at least one polymeric compound has hydrophobic character so that the adduct from (A) and the at least one functionalized magnetic particle agglomerate, (C) optionally, adding a further suspension medium to the mixture obtained in (B), (D) separating the agglomerate present in the suspension from (B) or (C) from the suspension by application of a magnetic field, (E) dissociating the agglomerate separated off in (D) by setting a temperature at which the polymeric compound has hydrophilic character in order to obtain the at least one first material.

2. The process according to claim 1, wherein the at least one polymeric compound is selected from the group consisting of a polyvinyl ether, a poly-N-alkylacrylamide, a poly-N-vinylcaprolactam, and a copolymer comprising at least one polymerized alkylene oxide.

3. The process according to claim 1, wherein the at least one polymeric compound is a compound of formula (III)

$$F\text{-}[(EO)_x\text{—}(PO)_y\text{—}(BuO)_z]\text{—}B \quad \text{(III)},$$

wherein

F is a functional group which binds selectively to the at least one magnetic particle, B is an alkyl radical having from 1 to 6 carbon atoms, EO is ethylene oxide, PO is propylene oxide, BuO is butylene oxide, x is an integer or fraction from 0 to 130, y is an integer or fraction from 0 to 130, and z is an integer or fraction from 0 to 130, where $1 \leqq x+y+z \leqq 130$.

4. The process according to claim 1, wherein the at least one second material is selected from the group consisting of an oxidic metal compound and a hydroxidic metal compound.

5. The process according to claim 1, wherein the at least one magnetic particle is selected from the group consisting of a magnetic metal, a ferromagnetic alloy of magnetic metals, a magnetic iron oxide, a hexagonal ferrite, and a cubic ferrite of formula (II)

$$M^{2+}{}_xFe^{2+}{}_{1-x}Fe^{3+}{}_2O_4 \quad \text{(II)},$$

wherein

M is at least one selected from the group consisting of Co, Ni, Mn, Zn, and $x \leqq 1$.

6. The process according to claim 1, wherein the LCST of the polymeric compound is from −10 to 100° C.

7. The process according to claim 1, wherein (B) is carried out at a temperature which is greater than the LCST of the polymeric compound and lower than a boiling point of the suspension medium employed.

8. The process according to claim 1, wherein (E) is carried out at a temperature which is above a melting point of the suspension medium employed and below the LCST of the polymeric compound.

9. The process according to claim 2, wherein the at least one polymeric compound is a compound of formula (III)

$$F\text{-}[(EO)_x\text{—}(PO)_y\text{—}(BuO)_z]\text{—}B \quad \text{(III)},$$

wherein

F is a functional group which binds selectively to the at least one magnetic particle, B is an alkyl radical having from 1 to 6 carbon atoms, EO is ethylene oxide, PO is propylene oxide, BuO is butylene oxide, x is an integer or fraction from 0 to 130, y is an integer or fraction from 0 to 130, and z is an integer or fraction from 0 to 130, where $1 \leqq x+y+z \leqq 130$.

10. The process according to claim 2, wherein the at least one second material is selected from the group consisting of an oxidic metal compound and a hydroxidic metal compound.

11. The process according to claim 3, wherein the at least one second material is selected from the group consisting of an oxidic metal compound and a hydroxidic metal compound.

12. The process according to claim 9, wherein the at least one second material is selected from the group consisting of an oxidic metal compound and a hydroxidic metal compound.

13. The process according to claim 2, wherein the at least one magnetic particle is selected from the group consisting of a magnetic metal, a ferromagnetic alloy of magnetic metals, a magnetic iron oxide, a hexagonal ferrite, and a cubic ferrite of formula (II)

$$M^{2+}_{x}Fe^{2+}_{1-x}Fe^{3+}_{2}O_4 \quad \text{(II)},$$

wherein

M is at least one selected from the group consisting of Co, Ni, Mn, Zn, and $x \leqq 1$.

14. The process according to claim 3, wherein the at least one magnetic particle is selected from the group consisting of a magnetic metal, a ferromagnetic alloy of magnetic metals, a magnetic iron oxide, a hexagonal ferrite, and a cubic ferrite of formula (II)

$$M^{2+}_{x}Fe^{2+}_{1-x}Fe^{3+}_{2}O_4 \quad \text{(II)},$$

wherein

M is at least one selected from the group consisting of Co, Ni, Mn, Zn, and $x \leqq 1$.

15. The process according to claim 4, wherein the at least one magnetic particle is selected from the group consisting of a magnetic metal, a ferromagnetic alloy of magnetic metals, a magnetic iron oxide, a hexagonal ferrite, and a cubic ferrite of formula (II)

$$M^{2+}_{x}Fe^{2+}_{1-x}Fe^{3+}_{2}O_4 \quad \text{(II)},$$

wherein

M is at least one selected from the group consisting of Co, Ni, Mn, Zn, and $x \leqq 1$.

16. The process according to claim 5, wherein the at least one magnetic particle is selected from the group consisting of a magnetic metal, a ferromagnetic alloy of magnetic metals, a magnetic iron oxide, a hexagonal ferrite, and a cubic ferrite of formula (II)

$$M^{2+}_{x}Fe^{2+}_{1-x}Fe^{3+}_{2}O_4 \quad \text{(II)},$$

wherein

M is at least one selected from the group consisting of Co, Ni, Mn, Zn, and $x \leqq 1$.

17. The process according to claim 2, wherein the LCST of the polymeric compound is from −10 to 100° C.

18. The process according to claim 2, wherein the LCST of the polymeric compound is from −10 to 100° C.

* * * * *